US006460527B1

(12) United States Patent
Doepner

(10) Patent No.: US 6,460,527 B1
(45) Date of Patent: Oct. 8, 2002

(54) TOY PROJECTILE SYSTEM

(75) Inventor: Matthias F. W. Doepner, Harleysville, PA (US)

(73) Assignee: Connector Set Limited Partnership, Hatfield, PA (US)

( * ) Notice: Subject to any disclaimer, the term of this patent is extended or adjusted under 35 U.S.C. 154(b) by 0 days.

(21) Appl. No.: 09/764,023

(22) Filed: Jan. 17, 2001

(51) Int. Cl.[7] ..... F41B 7/02; F41B 7/08
(52) U.S. Cl. ..... 124/16; 124/10
(58) Field of Search ..... 124/10, 16, 26

(56) References Cited

U.S. PATENT DOCUMENTS

| | | | | | |
|---|---|---|---|---|---|
| 2,002,100 | A | | 5/1935 | Smith | |
| 2,129,461 | A | * | 9/1938 | Boerger | 124/10 |
| 2,690,818 | A | | 10/1954 | Janeway | |
| 2,703,156 | A | | 3/1955 | Depallens | |
| 2,888,004 | A | * | 5/1959 | Steiner | 124/16 X |
| 3,327,814 | A | | 6/1967 | Nickell | |
| 3,510,979 | A | | 5/1970 | Fischer | |
| 3,718,326 | A | | 2/1973 | Ristau | |
| 4,696,655 | A | | 9/1987 | D'Andrade et al. | 446/330 |
| 4,760,985 | A | | 8/1988 | Stewart et al. | |
| 4,919,639 | A | | 4/1990 | Hesse | 446/462 |
| D311,942 | S | | 11/1990 | Dideriksen | |
| 5,083,454 | A | | 1/1992 | Yopp | |
| 5,090,934 | A | | 2/1992 | Quercetti | 446/93 |
| 5,096,452 | A | | 3/1992 | Wagener | 446/34 |
| 5,199,410 | A | * | 4/1993 | Cheng | 124/10 |
| 5,280,848 | A | | 1/1994 | Moore | |
| 5,322,469 | A | | 6/1994 | Tilbor | 446/454 |
| 5,338,247 | A | | 8/1994 | Miles | 446/456 |
| 5,380,231 | A | | 1/1995 | Brovelli | 446/6 |
| 5,427,558 | A | | 6/1995 | Knudsen et al. | 446/102 |
| 5,664,551 | A | * | 9/1997 | Spector | 124/16 |
| 5,934,419 | A | | 8/1999 | Riad | 188/129 |
| 6,193,582 | B1 | | 2/2001 | Gleim | 446/466 |

* cited by examiner

*Primary Examiner*—John A. Ricci
(74) *Attorney, Agent, or Firm*—Schweitzer Cornman Gross & Bondell LLP

(57) ABSTRACT

A projectile and launcher combination, in which the launcher is formed with a tubular passage having a convergently tapered inner end. A projectile element is provided at its back end with a plurality of rearwardly extending, cantilever mounted resilient leaf spring elements arranged to be received in and displaced radially inward by the convergently tapered portion of the tubular passage. When the projectile is loaded into the launcher, the leaf spring elements tend to eject it forwardly. A retention arrangement is provided to hold the projectile until it is ready to be ejected. When the projectile is released from retention, the outward pressure of the leaf spring elements on the convergent walls forcibly ejects the projectile from the launcher passage.

9 Claims, 3 Drawing Sheets

TOY PROJECTILE SYSTEM

RELATED APPLICATIONS

This application is related to U.S. Pat. No. 6,193,582, which is assigned to the owner of this invention, Connector Set Limited Partnership.

BACKGROUND AND SUMMARY OF THE INVENTION

This invention relates to the field of toys, and is particularly useful in connection with, but is not necessarily limited to, construction toys.

Many toy devices fire or launch projectiles in the course of simulating guns, artillery pieces, rockets, etc. This invention seeks to provide an extremely simple and inexpensive projectile system, consisting of a minimum number of simplified, economically manufactured molded plastic parts, in which toy projectiles are easily and effectively loaded and launched.

SUMMARY OF THE INVENTION

The projectile system of the present invention, in its most basic form, comprises two parts, a one-piece projectile and a one-piece launcher. The basic form of the invention can, of course, be presented in various forms and complexities, but always incorporating the basic component arrangement of projectile and launcher. The projectile element preferably is a one-piece molded plastic element having a projectile-shaped front end portion and a back end portion comprising a plurality of cantilever mounted leaf spring elements extending generally rearwardly and being capable of elastic displacement in a radially inward direction. In conjunction with the projectile element, there is a launcher element which defines a tubular passage arranged to receive at least portions of the projectile element, including the resilient leaf spring elements. The back portion of the tubular passage is convergently tapered in a front-to-back direction such that, when the projectile element is inserted axially into the launcher passage, the free ends of the cantilevered leaf spring elements will be engaged and radially inwardly displaced by the convergently tapered walls. The resiliently displaced leaf spring elements serve to urge the projectile in a launching direction. To provide for controlled launching, a retention arrangement is provided, consisting of elements on the projectile and on the launcher, which hold the projectile in its "loaded" ready-to-be-released position. When the retention elements are disengaged, the projectile is immediately ejected from the launcher, by the action of the resilient leaf springs on the tapered walls of the launcher passage.

In a particularly preferred embodiment of the invention, the projectile element is provided with a rearwardly projecting guide shaft, which is received in a through passage in the launcher and projects at least slightly from the back end of the launcher. The projectile, once loaded into the launcher, is released by forward pressure on the guide shaft, which can be accomplished manually (i.e. pressing a thumb or finger against the end of the shaft) or by suitable mechanical mechanisms.

In its most elemental form, each of the projectile and the launcher are simple, one-piece plastic moldings, which can be manufactured on, a high volume, low cost basis by known injection molding procedures.

For a more complete understanding of the above and other features and advantages of the invention, reference should be made to the following detailed description of a preferred embodiment and to the accompanying drawings.

DESCRIPTION OF PREFERRED EMBODIMENTS

Figure 1:
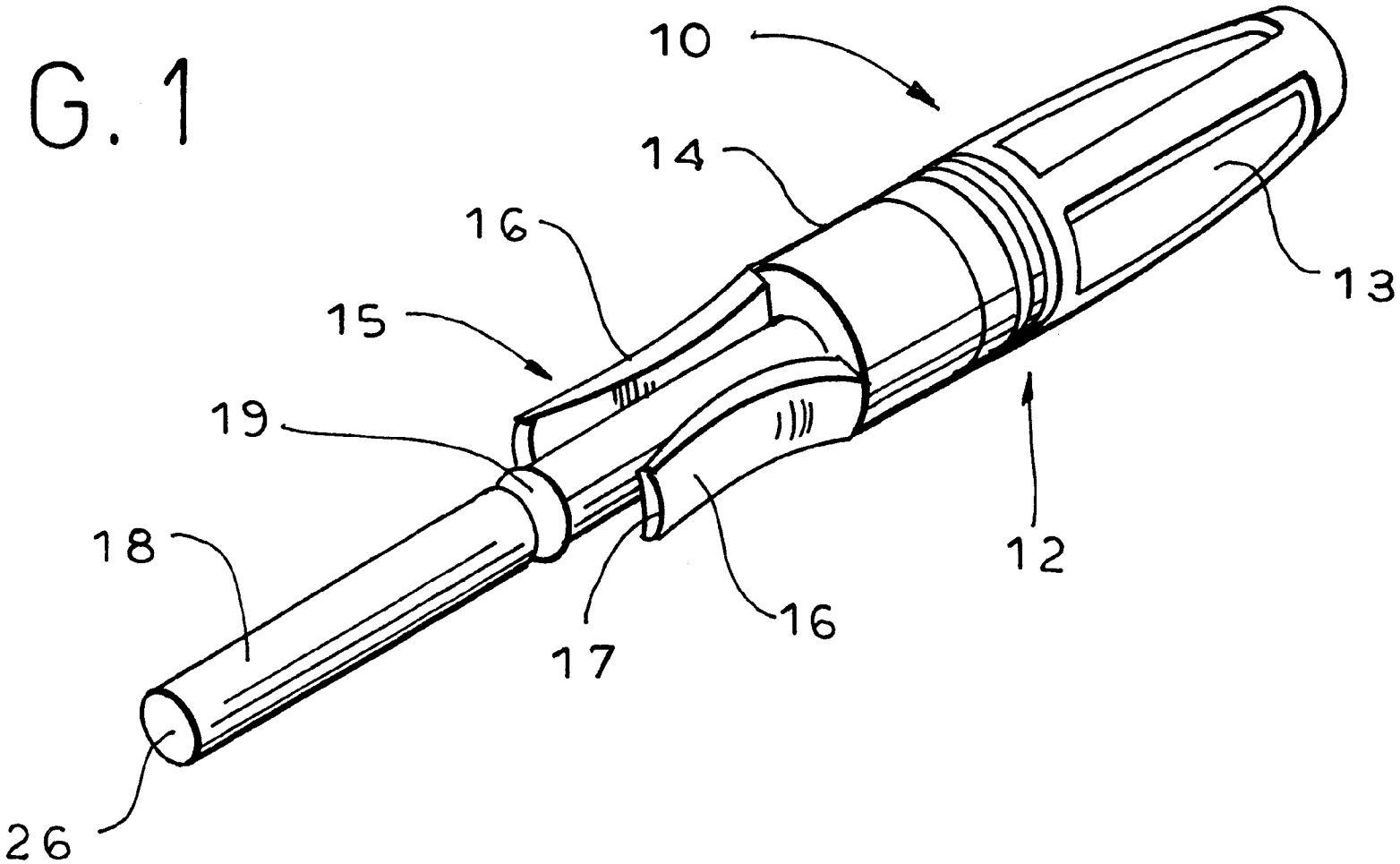
FIG. 1 is a perspective illustration of a projectile element constructed in accordance with the principles of the invention.

Referring now to the drawings, the reference numerals 10, 11 designate generally a projectile element and launcher constructed according to the invention. The projectile element 10 has a front portion 12 which is typically a body of revolution of suitable projectile shape, having a somewhat tapered leading end 13 and a generally cylindrical base 14. Pursuant to the invention, the back portion 15 of the projectile includes a plurality (typically two) of leaf spring elements 16 which are integrally mounted to the base 14 in a cantilever fashion and extend therefrom in a rearward direction. To advantage, the leaf spring elements 16 have a slightly concave external contour in a front-to-back direction. The leaf spring elements also desirably are tapered from front to back, in both width and thickness to accommodate flexing of the rearward end portions of the leaf spring elements.

Figure 2:
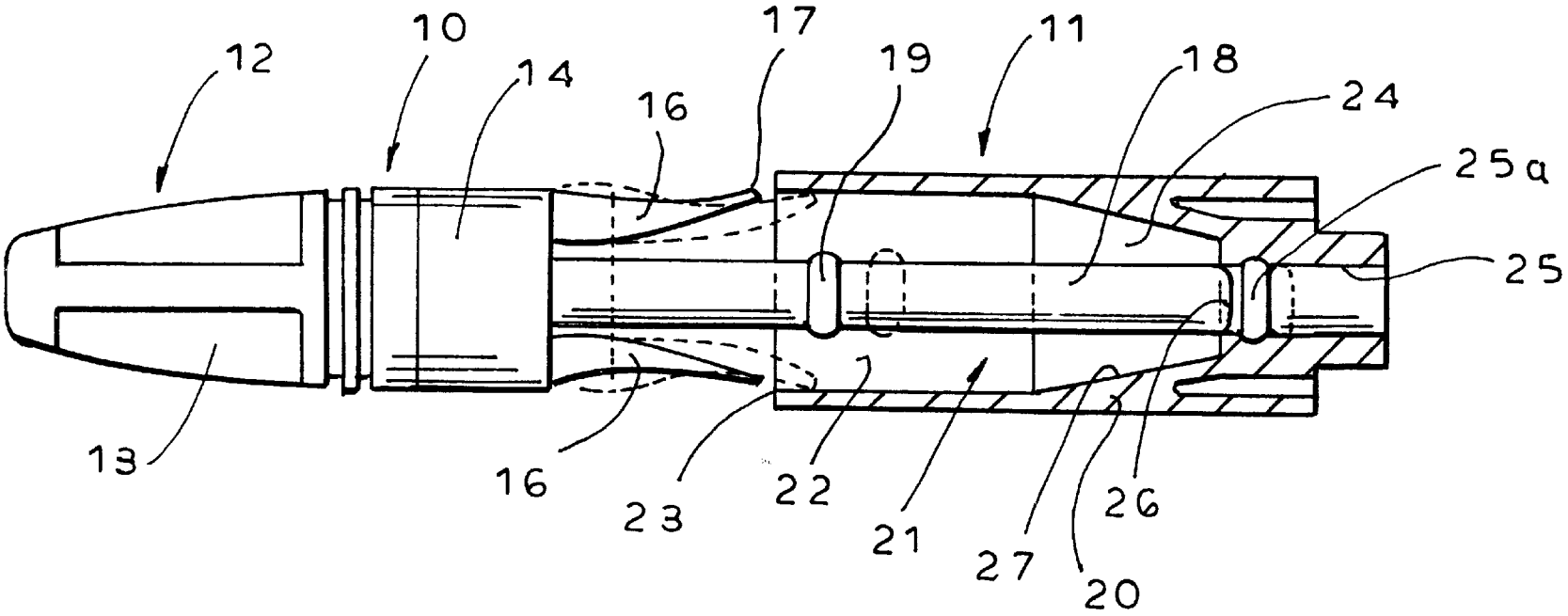
FIG. 2 is a side elevational view of a projectile and launcher, with the launcher shown in axial cross section, illustrating the manner in which a projectile is loaded into, or ejected from the launcher.

As reflected in FIG. 2, when the leaf spring elements 16 are in their "at rest" positions, the outer surfaces of the rearmost extremities 17 thereof lie approximately on an imaginary cylinder constituting an extension of the base portion 14. Additionally, as shown in FIG. 1, the outer surfaces of the end extremities are arcuately configured, preferably on a radius somewhat less than the radius of the cylindrical base 14, for purposes that will become evident.

In the preferred embodiment of the invention, a guide shaft 18 extends rearwardly from the base 14, along the axis of the projectile element. The guide shaft extends rearwardly well beyond the free ends of the leaf spring elements 16 and is provided, at a point somewhat rearward of the end extremities of the leaf spring elements, with a rounded annular enlargement 19, which is contoured to merge on each axial side thereof with the cylindrical contours of the guide shaft 18.

Figure 3:
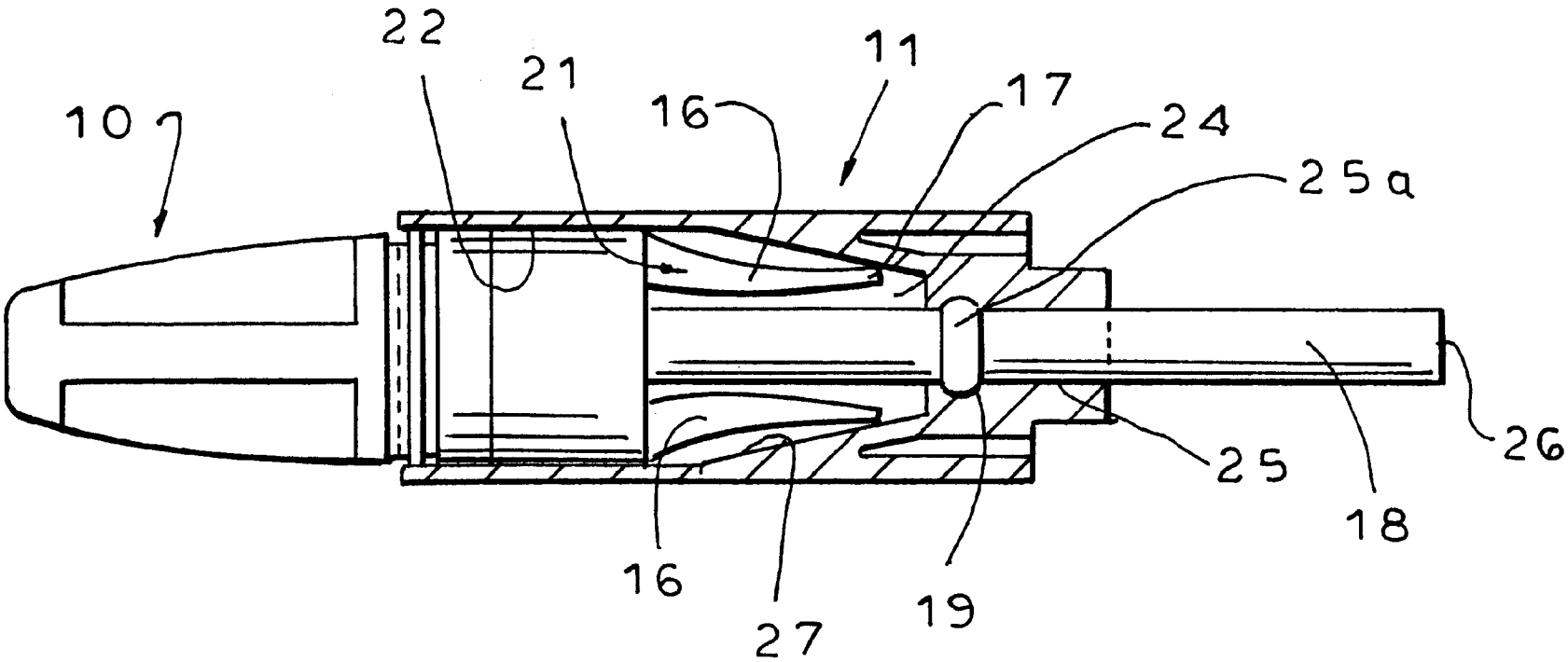
FIG. 3 is a side elevational view similar to FIG. 2, with the launcher shown in axial cross section, in which the projectile is shown in its loaded, ready-to-be-launched condition.

A single launcher unit is illustrated in axial cross section in FIGS. 2 and 3. The launcher unit comprises a suitably shaped body 20 formed with a tubular passage 21 comprising a generally cylindrical front portion 22, opening at the front 23 of the launcher body, and a back portion 24 which is convergently tapered in a front-to-back direction.

The internal diameter of the front passage portion 22 is slightly greater (e.g. a few thousands of an inch) than the outside diameter of the cylindrical base portion 14, such that the base portion 14 can be easily slideably received within the front portion 22 of the launcher passage. Likewise, the outermost surface extremities 17 of the leaf spring elements 16, in the normal or at-rest position of the leaf spring elements, is such that the tip edges 17 of the leaf springs easily fit within the walls of the passage front portion 22.

At its back end, the launcher 11 is provided with a through opening 25 of a diameter to freely slideably receive the guide shaft 18 of the projectile element 10. To advantage, the length of the guide shaft 18 is such, in relation to the length of the tubular passage 21, that the rearward end extremity 26 of the guide shaft enters the through opening 25 before the leaf spring elements 16 reach the front of the convergently tapered passage portion 24, and preferably before reaching the front opening 23 of the launcher. In this manner, the guide shaft assists in guiding the projectile element into the launcher passage.

As indicated in FIG. 3, as the projectile element 10 is loaded into the launcher, the tip edges 17 of the leaf spring elements 16 engage the walls 27 of the convergently tapered passage portion 24. As the projectile is pressed deeper into the launcher passage 21, the leaf spring elements 16 are displaced radially inwardly toward the axis of the projectile. During this portion of the loading operation, the projectile must be forcibly pressed into the launcher against the resistance of the resiliently displaced leaf spring elements 16, which tend to eject the projectile element from the launcher.

As the projectile element approaches its position of maximum insertion into the loader, the annular enlargement 19 enters the through opening 25. The diameter of the through opening is such that it closely but loosely receives the main body of the guide shaft 18. The parts are dimensioned so that there is an interference fit between the annular enlargement 19 and the internal walls of the through opening 25. Additionally, the through opening 25 is provided adjacent its forward end with a shallow annular groove 25*a* adapted to receive the enlargement 19. Thus, during the last portion of the projectile loading operation, extra force must be applied to the projectile element to force the annular enlargement 19 into the opening 25. This initially compresses the enlargement and causes it to enter the groove 25*a* with a perceptible snap action. The grip between the enlargement 19 and the annular groove 25*a* is such that the projectile element 10 is retained in its loaded position, overcoming the axially directed forces of the leaf springs 16 pressing against the tapered walls 24, which are tending to eject the projectile from the launcher.

When the projectile is in its fully loaded position, the rearwardmost end of the guide shaft 18 projects rearwardly of the launcher body. In order to launch the projectile, pressure is applied to the back end 26 of the guide shaft sufficient to force the projectile forward relative to the launcher, until the annular enlargement 19 is displaced out of the annular groove 25*a* and the forward end of the through opening 25. As soon as the guide shaft is free to move, the projectile is forcibly ejected from the launcher by reason of the outward force of the leaf springs 16 on the tapered walls 27. The projectile is subject to ejecting forces, and thus continues to be accelerated, until the tip edges 17 of the leaf spring elements advance to the cylindrical outer portion 22 of the launcher passage 21. At this point, the forward momentum of the projectile carries the projectile the rest of the way out of the passage 21 and launches the projectile on its desired trajectory.

Initial displacement of the projectile for launching may be effected by manually pushing against the end 26 of the guide shaft 18 with the thumb or finger of the user, or by suitable mechanical devices (not shown) operative to press against or strike the end 26 of the guide shaft.

Preferably, the launcher and projectile elements are formed by relatively precision injection molding of plastic materials. For the projectile element 10, a preferred material is an acedal copolymer, such as Celcon M270, made available by Hoechst Celanese. This material is desired for its strength and good "memory" characteristics, which are especially beneficial for the repetitively deflected leaf spring elements 16 and the repetitively compressed annular enlargement 19. The launcher, on the other hand, preferably is of a nylon plastic, which is advantageous for its low friction characteristics, to enhance the ejecting action of the leaf spring elements within the convergently tapered passage portion 24.

In a typical toy installation, a plurality of launcher elements 11 may be arranged in a group to provide a multi-unit projectile launcher, for example. Likewise, the launcher may be incorporated into a toy gun barrel. It is contemplated that the basic concepts of the invention may be utilized in a wide variety of ways to provide interesting and exciting toy projectile launcher devices.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A toy projectile system which comprises (a) a projectile element having front and back end portions, (b) said back portion comprising a plurality of generally rearwardly extending, cantilevered leaf spring elements, (c) said projectile system further including a launcher defining a tubular passage having front and back portions and having an axis (d) the front portion of said tubular passage having an open end and having a cross sectional configuration suitable for slidably receiving at least portions of said projectile element, (e) the back portion of said tubular passage being convergently tapered in a front-to-back direction whereby, when a projectile element is loaded into said tubular passage in a front-to-back direction to a predetermined load position, said cantilevered leaf spring elements are resiliently displaced in a radially inward direction toward said axis and function to resiliently urge said projectile element in a back-to-front direction, (f) cooperating retention elements associated with said projectile element and said launcher for temporarily restraining said projectile in said load position, and (g) a displaceable element, operable when said projectile element is in said load position for displacing one of said retention elements to a position in which said projectile element is no longer restrained, (h) said projectile element being thereupon ejected from said launcher.

2. A toy projectile system according to claim 1, wherein (a) said displaceable element comprises a shaft extending rearwardly from said projectile element, (b) said launcher having a through opening extending rearward from said convergently tapered back portion, (c) said shaft being received in said through opening and being engageable and forwardly displaceable when said projectile element is in said load position.

3. A toy projectile system according to claim 2, wherein (a) said shaft extends completely through and projects rearwardly of said through opening when said projectile element is in said load position, (b) rearward extremities of said shaft being engageable and forwardly displaceable to effect launching of said projectile.

4. A toy projectile system according to claim 2, wherein (a) at least one of said shaft and through opening is provided with an interference-forming portion operative, when said projectile element is in the load position, to frictionally retain said projectile element in said position until said shaft is forceably displaced forwardly at least a short distance from said load position.

5. A toy projectile system according to claim 4, wherein (a) said interference-forming portion is in the form of an enlargement on said shaft and a recess in walls of said through opening, engaged when said projectile element is in said load position.

6. A toy projectile system according to claim 1, wherein (a) said projectile element is formed of an acetal copolymer, and said launcher is formed of nylon.

7. A toy projectile system according.to claim 1, wherein (a) the front portion of said tubular passage has a cross sectional configuration suitable for the reception of at least part of the front portion of said projectile element when said projectile element is in said load position.

8. A toy projectile system according to claim 7, wherein (a) said displaceable element comprises a shaft extending rearwardly from said projectile element, (b) said launcher having a through opening extending rearward from said convergently tapered back portion, (c) said shaft being received in said through opening and being engagable and forwardly displaceable when said projectile element is in said load position, (d) the length of said shaft being such, in relation to the length of said tubular passage that, when a projectile element is loaded into said launcher, said shaft is received in said through opening prior to said leaf spring elements being received in said convergently tapered tubular passage portion.

9. A toy projectile system according to claim 8, wherein (a) said shaft is formed with an annular enlargement adapted for an interference fit within said through opening, (b) said through opening being formed with an annular groove of a size to receive said annular enlargement, (c) said annular enlargement being received in said annular groove when said projectile element is in said load position.

* * * * *